US009286856B2

(12) United States Patent
Park et al.

(10) Patent No.: US 9,286,856 B2
(45) Date of Patent: Mar. 15, 2016

(54) DISPLAY DEVICE INCLUDING A WHITE SUB-PIXEL AND METHOD OF DRIVING THE SAME

(71) Applicant: Samsung Display Co., Ltd., Yongin, Gyeonggi-do (KR)

(72) Inventors: Jong-Woong Park, Yongin (KR); Won-Woo Jang, Yongin (KR); Ju-Hyung Lee, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 273 days.

(21) Appl. No.: 13/745,606

(22) Filed: Jan. 18, 2013

(65) Prior Publication Data

US 2014/0071189 A1 Mar. 13, 2014

(30) Foreign Application Priority Data

Sep. 7, 2012 (KR) ..... 10-2012-0099545

(51) Int. Cl.

| | |
|---|---|
| ***G09G 3/36*** | (2006.01) |
| ***G09G 5/02*** | (2006.01) |
| ***G09G 3/20*** | (2006.01) |
| ***G09G 3/32*** | (2006.01) |

(52) U.S. Cl.

CPC ..... *G09G 5/02* (2013.01); *G09G 3/2074* (2013.01); *G09G 3/3225* (2013.01); *G09G 3/3607* (2013.01); *G09G 2300/0426* (2013.01); *G09G 2300/0452* (2013.01); *G09G 2320/0242* (2013.01); *G09G 2340/06* (2013.01)

(58) Field of Classification Search

CPC ... G09G 5/02; G09G 3/3607; G09G 2340/06; G09G 2320/0233; G09G 2360/144

USPC ..... 345/88, 76, 690

See application file for complete search history.

(56) References Cited

U.S. PATENT DOCUMENTS

| | | | | |
|---|---|---|---|---|
| 5,929,843 | A * | 7/1999 | Tanioka | 345/600 |
| 6,911,961 | B2 | 6/2005 | Miller et al. | |
| 6,995,519 | B2 * | 2/2006 | Arnold et al. | 315/169.3 |
| 7,742,026 | B2 | 6/2010 | Lee et al. | |
| 7,911,486 | B2 * | 3/2011 | Fan Chiang et al. | 345/690 |
| 2003/0164810 | A1 * | 9/2003 | Kim | 345/63 |
| 2008/0297448 | A1 * | 12/2008 | Mizukoshi et al. | 345/76 |
| 2008/0315788 | A1 * | 12/2008 | Levey et al. | 315/291 |
| 2009/0059078 | A1 * | 3/2009 | Kim et al. | 348/645 |
| 2009/0243976 | A1 * | 10/2009 | Choi | 345/76 |
| 2010/0091030 | A1 * | 4/2010 | Park et al. | 345/589 |
| 2010/0103187 | A1 * | 4/2010 | Linssen | 345/590 |
| 2011/0292087 | A1 | 12/2011 | Lim | |
| 2012/0268353 | A1 * | 10/2012 | Mizukoshi et al. | 345/76 |

FOREIGN PATENT DOCUMENTS

KR 10-2011-0130126 A 12/2011

* cited by examiner

*Primary Examiner* — Chanh Nguyen
*Assistant Examiner* — Yuzhen Shen
(74) *Attorney, Agent, or Firm* — Knobbe, Martens, Olson & Bear, LLP

(57) ABSTRACT

A display device is disclosed. The display device has pixels which include three color sub-pixels, for example, red, green, and blue sub-pixels. The pixels also include a white sub-pixel. The display calculates data for the red, green, blue, and white sub-pixels based on data for red, green, and blue sub-pixels.

16 Claims, 6 Drawing Sheets

DISPLAY DEVICE INCLUDING A WHITE SUB-PIXEL AND METHOD OF DRIVING THE SAME

CROSS-REFERENCE TO RELATED APPLICATIONS

This application claims the benefit of Korean Patent Application No. 10-2012-0099545, filed on Sep. 7, 2012, in the Korean Intellectual Property Office, the disclosure of which is incorporated herein in its entirety by reference.

BACKGROUND

1. Field

A technical aspect of the present invention relates to a display device, and more particularly, to a display device including red, green, blue, and white (RGBW) sub-pixels.

2. Description of the Related Technology

In the field of organic light-emitting diode (OLED) TVs, white OLED (WOLED) technologies, which are advantageous in manufacturing large OLEDs having high resolution, are being actively developed. In a WOLED, color data for realizing white in an RGB signal may be realized without using a color filter as the WOLED additionally includes a white sub-pixel. Also, since the color data is realized without using a color filter, luminous intensity is generally not reduced.

As of today, there are two generally recognized methods for realizing white while driving a display panel of a WOLED display device using red, green, blue, and white (RGBW) sub-pixels. In other words, white may be realized by using a white sub-pixel without using a color filter or by combining red, green and blue realized through RGB color filters.

SUMMARY OF CERTAIN INVENTIVE ASPECTS

One inventive aspect is a display device including a data mapping unit. The data mapping unit is configured to determine a minimum value from input color data of three colors, to determine white output color data by multiplying the minimum value by a gain ratio, and to determine output color data of the three colors by subtracting the white output color data from each of the input color data of 3 colors. The display device also includes a gain adjustment unit for adaptively changing the gain ratio based on an image being displayed, and a display panel including a unit pixel formed of white sub-pixels and sub-pixels of each of the three colors, where the display panel is configured to display an image using the sub-pixels according to the output color data of the three colors and the white output color data.

Another inventive aspect is a method of driving a display device including a display panel with a unit pixel formed of red, green, blue, and white sub-pixels. The method includes extracting, by a data mapping unit, a minimum value from red, green, and blue input color data, determining, by the data mapping unit, white output color data by multiplying the extracted minimum value with a gain ratio, and determining, by the data mapping unit, red, green, and blue output color data by subtracting the white output color data from each of the red, green, and blue input color data. The method also includes adaptively changing, by a gain adjustment unit, the gain ratio based on an image being displayed, and displaying, by a display panel, an image corresponding to the white output color data and the red, green, and blue output color data.

Another inventive aspect is a display device including a display panel with a plurality of unit pixels each formed of red, green, blue, and white sub-pixels. The display device also includes a data driver configured to supply one of four color data signals corresponding to red, green, blue, and white output color data to each of the plurality of unit pixels. The display device also includes a gate driver configured to supply a gate-on voltage to the plurality of unit pixels, and a time controller configured to control the data driver and the gate driver, and to supply the red, green, blue, and white output color data to the data driver. The time controller includes a gain adjustment unit configured to determine a minimum value from red, green, and blue input color data, and to determine the white output color data by multiplying the minimum value with a gain ratio that adaptively changes based on an image being displayed, and a data mapping unit configured to determine red, green, blue, and white output color data by subtracting the white output color data from the red, green, and blue input color data.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF CERTAIN INVENTIVE EMBODIMENTS

Figure 1:
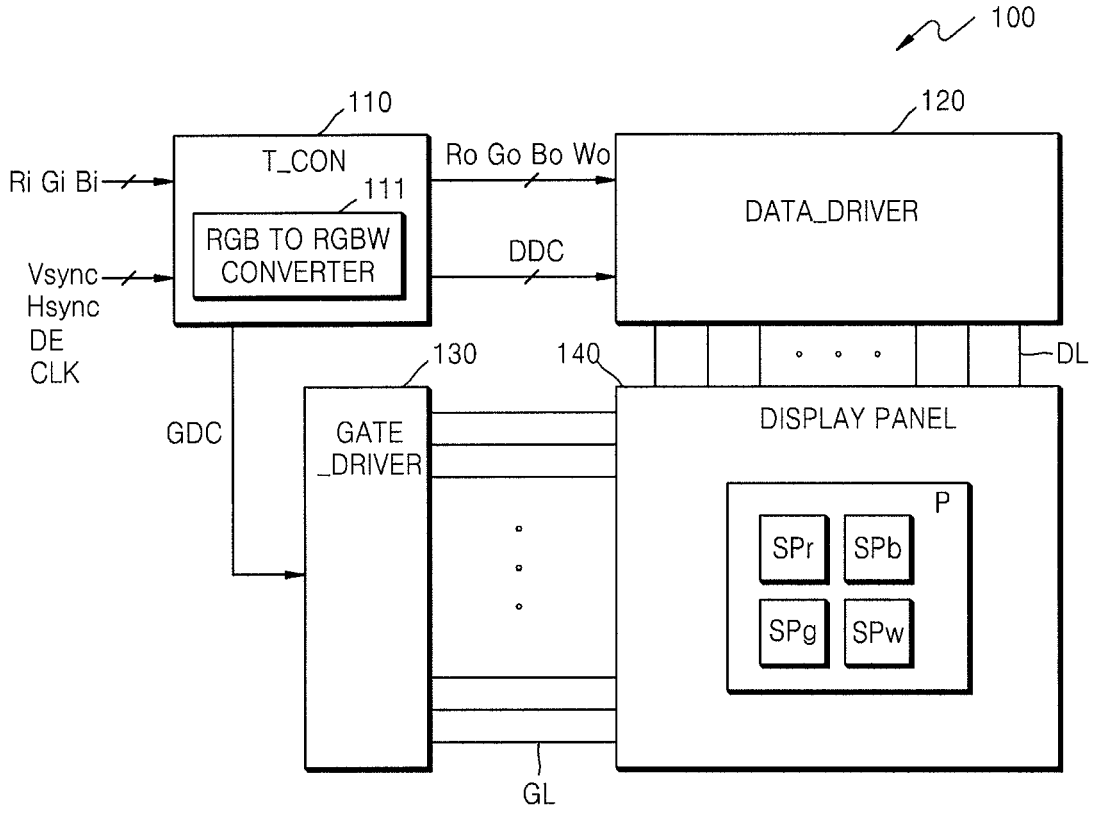
FIG. 1 is a block diagram of a display device according to an embodiment of the present invention.

Hereinafter, the present invention will be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, like reference numerals denote like elements, and the sizes and thicknesses of layers and regions are exaggerated for clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/ or components, but do not preclude the presence or addition of one or more other features, integers, steps, operations, elements, components, and/or groups thereof.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram of a display device 100 according to an embodiment of the present invention. Referring to FIG. 1, the display device 100 may include a display panel 140, a time controller 110, a data driver 120, and a gate driver 130.

In the display panel 140, a plurality of data lines DL and a plurality of gate lines GL cross each other, and a plurality of pixels P each including 4 sub-pixels are arranged in crossing regions. For full color realization, the pixel P may include a red (R) sub-pixel SPr for emitting R light, a green (G) sub-pixel SPg for emitting G light, a blue (B) sub-pixel SPb for emitting B light, and a white (W) sub-pixel SPw for emitting W light. One pixel is shown in FIG. 1 for convenience of description, and the number of pixels P included in the display panel 140 may vary according to an application.

Figure 2A:
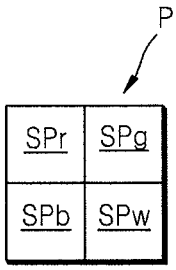
FIGS. 2A-2C illustrate various arrangements of sub-pixels in one pixel.
Figure 2B:
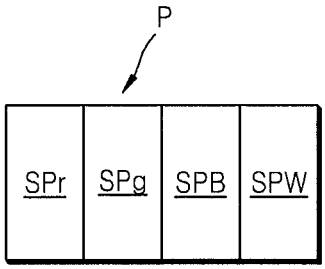
Figure 2C:
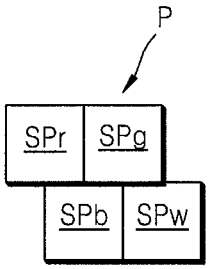

FIG. 2 illustrates various arrangements of sub-pixels in one pixel P. Referring to FIG. 2, the sub-pixels in the pixel P may have a checkered arrangement as two data lines and two gate lines cross each other as shown in FIG. 2 (A) or a stripe type arrangement as four data lines and one gate line cross each other as shown in FIG. 2 (B). Alternatively, the sub-pixels in the pixel P may have a checkered arrangement as two data lines and two gate lines cross each other, wherein sub-pixels SPr and SPg at an upper row and sub-pixels SPb and SPw at a lower row are misaligned as shown in FIG. 2 (C).

Figure 3:
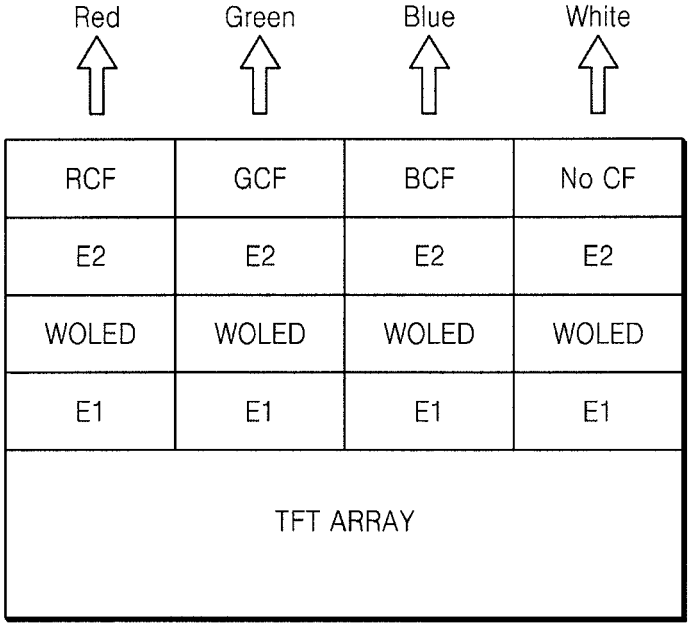
FIG. 3 is a diagram of a stacked structure of sub-pixels in one pixel.

FIG. 3 is a diagram of a stacked structure of sub-pixels in one pixel. Referring to FIG. 3, R, G, B, and W sub-pixels SPr, SPg, SPb, and SPw each include a white organic light-emitting diode (WOLED). The WOLED has a structure in which an R emission layer, a G emission layer, and a B emission layer are selectively stacked between a cathode and an anode. The WOLED is in sub-pixel units. As shown in FIG. 3, the R sub-pixel SPr includes an R color filter RCF through which only red light penetrates from among white light incident from the WOLED, the G sub-pixel SPg includes a G color filter GCF through which only green light penetrates from among the white light incident from the WOLED, and the B sub-pixel SPb includes a B color filter BCF through which only blue light penetrates from among the white light incident from the WOLED. However, the W sub-pixel SPw does not include a color filter, and may compensate for luminance deterioration of an image caused by the R, G, and B color filters RCF, GCF, and BCF by allowing the white light incident from the WOLED to penetrate.

In FIG. 3, E1 may be an anode (or a cathode) and E2 may be a cathode (or an anode). E1 is electrically connected to a driving thin film transistor (TFT) formed in a lower TFT array in sub-pixel units. The lower TFT array includes the driving TFT according to sub-pixels, at least one switch TFT, and a storage capacitor, and is connected to a data line DL and a gate line GL in sub-pixel units.

Referring back to FIG. 1, the data driver 120 converts output color data RoGoBoWo of 4 colors of which color coordinates are compensated for into an analog data voltage and supplies the analog data voltage to the data lines DL, under the control of the time controller 110.

The gate driver 130 selects a horizontal line to which a data voltage is to be applied, by generating and supplying a scan pulse sequentially to the gate lines GL under the control of the time controller 110.

The time controller 110 generates a data control signal DDC for controlling an operation timing of the data driver 120 and a gate control signal GDC for controlling an operation timing of the gate driver 130, based on timing signals, such as vertical synchronization signal Vsync, a horizontal synchronization signal Hsync, a clock signal CLK, and a data enable signal DE.

The time controller 110 may include an RGB-to-RGBW converter 111. The RGB-to-RGBW converter 111 may receive input color data RiGiBi of 3 colors from outside the display device 100, and supply the output color data RoGoBoWo of 4 colors of which color coordinates are converted to the data driver 120. Alternatively, the RGB-to-RGBW converter 111 may be realized in the data driver 120 or a separate chip, and may vary according to an application.

Two methods are used to realize white while driving each sub-pixel included in a display panel. In other words, white may be realized by using a W sub-pixel without using a color filter or by combining red, green, and blue realized via RGB color filters.

When a ratio of realizing white by using a W sub-pixel is increased, a driving load is concentrated in the W sub-pixel, and thus the W sub-pixel is quickly degraded, thereby decreasing an overall life of a pixel. On the other hand, when a ratio of realizing white by using R, G, and B sub-pixels is increased, power consumption is increased by using all of the R, G, and B sub-pixels. Accordingly, since a life and power consumption are in a trade off relationship, a gain ratio ga needs to be suitably updated according to an image being displayed.

The RGB-to-RGBW converter 111 according to an embodiment may include a data mapping unit and a gain adjustment unit to adaptively change a gain ratio based on an image being displayed, thereby consuming low power and realizing a pixel having a long life. An operation of obtaining the output color data RoGoBoWo of 4 colors by converting color coordinates of the input color data RiGiBi of 3 colors will now be described in detail.

Figure 4A:
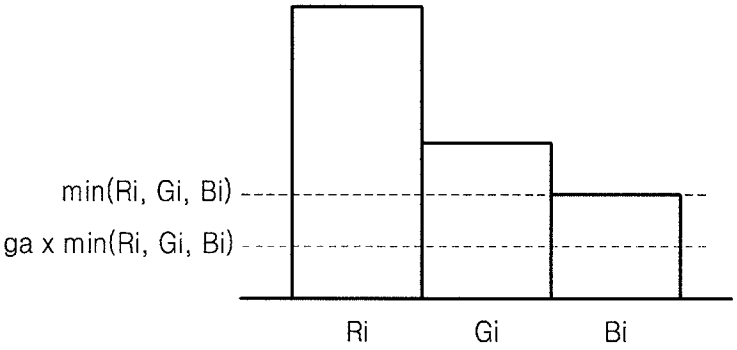
FIGS. 4A and 4B is a graph for describing an operation of obtaining output color data of 4 colors by converting color coordinates of input color data of 3 colors.
Figure 4B:
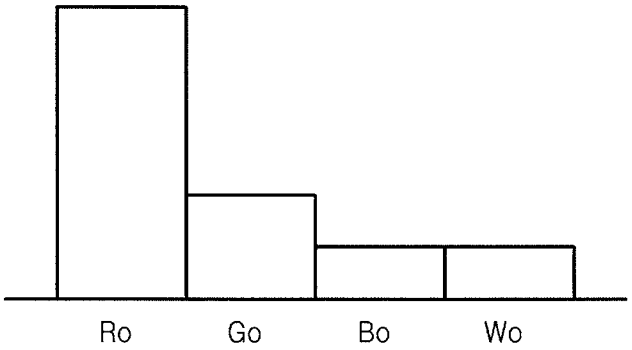

FIGS. 4A and 4B is a graph for describing an operation of obtaining output color data RoGoBoWo of 4 colors by converting color coordinates of input color data RiGiBi of 3 colors.

Referring to FIGS. 4A and 4B, the operation of obtaining the output color data RoGoBoWo of 4 colors by converting the color coordinates of the input color data RiGiBi of 3 colors may be performed as follows: First, a minimum value is extracted from the input color data RiGiBi. Then, white output color data is determined by multiplying the extracted minimum value and a gain ratio ga. Then, the white output color data is subtracted from each of the input color data RiGiBi to determine output color data of red, green, and blue. Such processes may be represented by Equation 1 below:

$$Wo = ga \times \min[Ri, Gi, Bi]$$

$$Ro = Ri - Wo$$

$$Go = Gi - Wo$$

$$Bo = Bi - Wo \qquad \text{Equation 1}$$

Here, the gain ratio ga is between 0 and 1. Thus, when the gain ratio ga is high, a ratio of realizing white by using a W sub-pixel is high, and when the gain ratio ga is low, a ratio of realizing white by using R, G, and B sub-pixels is high.

A display device according to an embodiment of the present invention includes a data mapping unit and a gain adjustment unit to adaptively change the gain ratio ga based on an image being displayed, thereby consuming low power and realizing a pixel having a long life.

In detail, the gain adjustment unit according to an embodiment of the present invention may calculate an accumulated sum of color data used according to sub-pixels in the image being displayed according to frames or regular frame intervals, and suitably adjust the gain ratio ga by using the accumulated sum. The gain adjustment unit according to another embodiment of the present invention may suitably adjust the gain ratio ga based on saturation of the image being displayed.

Figure 5:
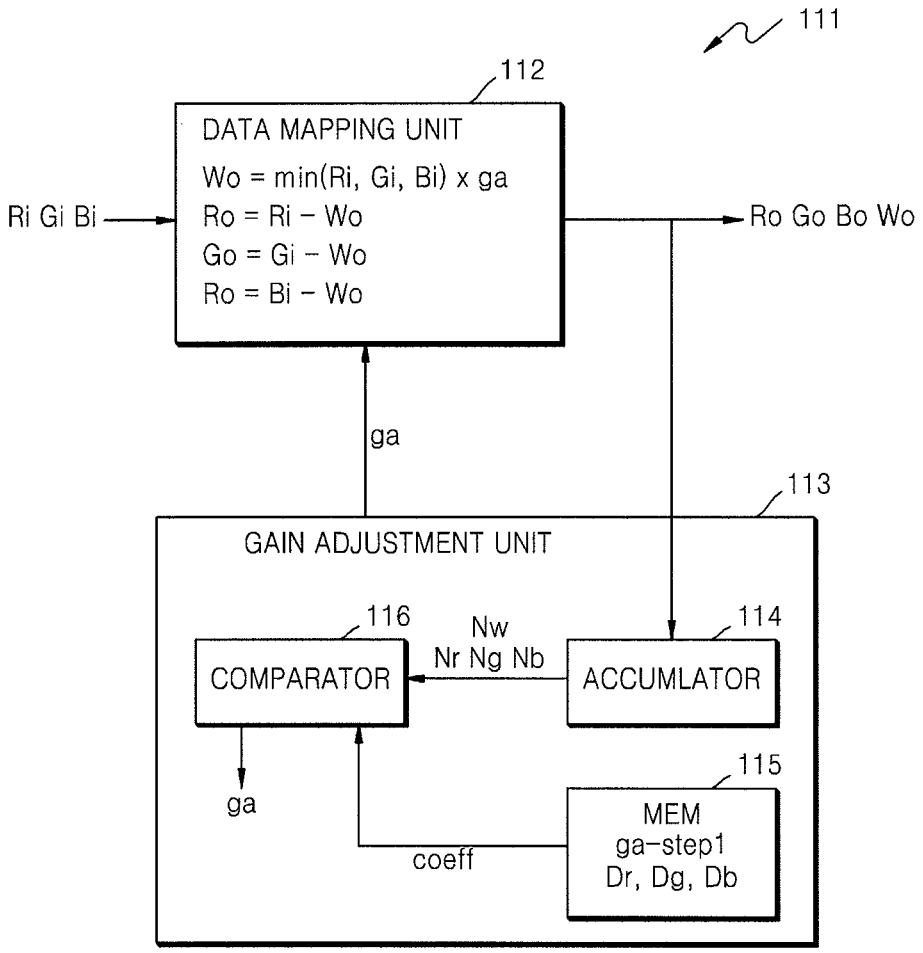
FIG. 5 is a diagram illustrating an RGB-to-RGBW converter according to an embodiment of the present invention in detail.

FIG. 5 is a diagram illustrating the RGB-to-RGBW converter 111 according to an embodiment of the present invention in detail. Referring to FIG. 5, the RGB-to-RGBW converter 111 includes a data mapping unit 112 and a gain adjustment unit 113.

The data mapping unit 112 generates output color data RoGoBoWo of 4 colors by receiving input color data RiGiBi of 3 colors. The data mapping unit 112 receives and uses a gain ratio ga from the gain adjustment unit 113 to generate the output color data RoGoBoWo.

The gain adjustment unit 113 may include an accumulator 114, a comparator 116, and a memory 115.

The accumulator 114 may receive the output color data RoGoBoWo of each sub-pixel according to frames. The accumulator 114 accumulates color data of all pixels per frame according to colors. Such operations may be represented by Equation 2 below:

$$Nw' = \sum^{ALLPixels} Wo \qquad \text{Equation 2}$$

$$Nr' = \sum^{ALLPixels} Ro$$

$$Ng' = \sum^{ALLPixels} Go$$

$$Nb' = \sum^{ALLPixels} Bo$$

$$Nw = \sum^{ALLFrames} Nw'$$

$$Nr = \sum^{ALLFrames} Nr'$$

$$Ng = \sum^{ALLFrames} Ng'$$

$$Nb = \sum^{ALLFrames} Nb'$$

Here, Nw denotes an accumulated sum of white color data, Nr denotes an accumulated sum of red color data, Ng denotes an accumulated sum of green color data, and Nb denotes an accumulated sum of blue color data.

The accumulator 114 may transmit the accumulated sums of color data used according to sub-pixels to the comparator 116, according to frames or regular frame intervals.

The memory 115 may be a volatile or nonvolatile memory. Alternatively, the memory 115 may be a random access memory (RAM) or a read-only memory (ROM). Alternatively, the memory 115 may be a dynamic RAM (DRAM), a static RAM (SRAM), a phase-change RAM (PRAM), a magnetic RAM (MRAM), a resistive RAM (ReRAM), a ferroelectric RAM (FRAM), a NOR flash memory, a NAND flash memory, or a fusion flash memory (for example, a memory including an SRAM buffer, a NAND flash memory, and a NOR interface logic).

The memory 115 may include coefficients coeff required for a comparison process performed by the comparator 116. The coefficients coeff may include a first unit value ga_step1 for increasing the gain ratio ga, and weights Dr, Dg, and Db multiplied to the accumulated sums Nw, Nr, Ng, and Nb of color data. The coefficients coeff stored in the memory 115 may be updated. The first unit value ga_step 1 may be determined considering a display state. The weights Dr, Dg, and Db may be determined according to a degradation tendency and a display state.

The memory 115 may transmit the coefficients coeff required for the comparison process to the comparator 116.

The comparator 116 may receive the accumulated sums Nw, Nr, Ng, and Nb of the color data used according to sub-pixels from the accumulator 114, and may receive the coefficients coeff required for the comparison process from the memory 115.

The comparator 116 may calculate an R comparative value, a G comparative value, and a B comparative value by multiplying the corresponding weights to the accumulated sums Nr, Ng, and Nb. The comparator 116 may calculate a W comparative value by using the accumulated sum Nw. The comparator 116 may compare the W comparative value and a sum of the R comparative value, the G comparative value, and the B comparative value.

When the sum of the R comparative value, the G comparative value, and the B comparative value is higher than the W comparative value, the comparator 116 may decrease the gain ratio ga by the first unit value ga_step1, and when the sum of the R comparative value, the G comparative value, and the B comparative value is lower than the W comparative value, the comparator 116 may increase the gain ratio ga by the first unit value ga_step1. Such a process may be represented by PseudoCode 1 below:

| Pseudocode 1 |
|---|
| if, Nw > (Dr H Nr + Dg H Ng + Db H Nb ) |
| then, ga = ga − ga_step1 |
| else, ga = ga + ga_step1 |

The comparator 116 outputs the calculated gain ratio ga and the gain adjustment unit 113 transmits the gain ratio ga to the data mapping unit 112. The data mapping unit 112 performs RGB-to-RGBW conversion by using the updated gain ratio ga. Accordingly, a display device according to an embodiment calculates the accumulated sums Nw, Nr, Ng, and Nb of color data used according to sub-pixels in the image being displayed, according to frames or regular frame intervals, and suitably adjust the gain ratio ga by using the accumulated sums Nw, Nr, Ng, and Nb, thereby consuming low power and realizing a pixel having a long life.

Figure 6:
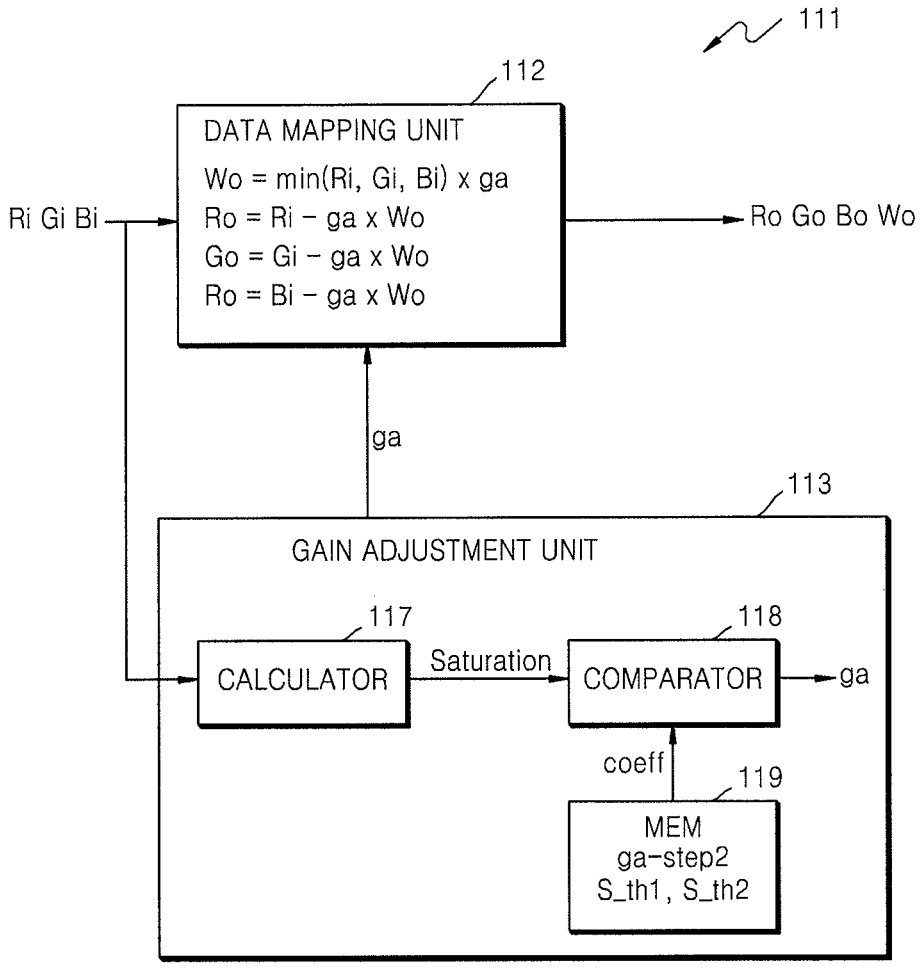
FIG. 6 is a diagram illustrating an RGB-to-RGBW converter according to another embodiment of the present invention in detail.

FIG. 6 is a diagram illustrating the RGB-to-RGBW converter 111 according to another embodiment of the present invention in detail. Referring to FIG. 6, the RGB-to-RGBW converter 111 includes a data mapping unit 112 and a gain adjustment unit 113.

Since the data mapping unit 112 and a memory 119 of FIG. 6 are respectively similar or identical to the data mapping unit 112 and the memory 115 of FIG. 5, details thereof are not repeated.

The gain adjustment unit 113 may include a calculator 117, a comparator 118, and the memory 119.

The calculator 117 may receive input color data RiGiBi of 3 colors, and calculate saturation S of a corresponding frame by using Equation 3 below:

$$S = \sum^{ALLPixels} \frac{\mathrm{Max}(Rin, Gin, Bin) - \mathrm{Min}(Rin, Gin, Bin)}{\mathrm{Max}(Rin, Gin, Bin)} \quad \text{Equation 3}$$

Here, when a value of the saturation S is high, an image has high saturation and when a value of the saturation S is low, an image has low saturation. Thus, as the value of saturation S increases, a gain ratio ga may be increased to reduce overall power consumption, and as the value of saturation S decreases, the gain ratio ga may be decreased to improve a life of a pixel. The calculator 117 may transmit the calculated saturation S to the comparator 118.

The memory 119 may include a first reference value S_th1 and a second reference value S_th2 required for a comparison process performed by the comparator 118. Also, the memory 119 may include a second unit value ga_step2 for increasing the gain ratio ga. Coefficients coeff stored in the memory 119 may be updated. The first reference value S_th1, the second reference value S_th2, and the second unit value ga_step2 may be determined considering a display state.

The memory 119 may transmit the coefficients coeff required for the comparison process performed by the comparator 118.

The comparator 118 may compare the calculated saturation S with the first and second reference values S_th1 and S_th2. In detail, when the saturation S of a frame is higher than the first reference value S_th1, the gain ratio ga is decreased, and when the saturation S of a frame is lower than the second reference value S_th2, the gain ratio ga may be increased. This may be represented by PseudoCode 2 below:

Pseudocode 2

```
if, S > S_th1
    then, ga = ga − ga_step2
else if, S < S_th1
    then, ga = ga + ga_step2
```

The comparator 118 outputs the calculated gain ratio ga, and the gain adjustment unit 113 transmits the gain ratio ga to the data mapping unit 112. The data mapping unit 112 performs RGB-to-RGBW conversion with the updated gain ratio ga. Accordingly, a display device according to an embodiment suitably adjusts the gain ratio ga based on the saturation S of the image being displayed, thereby consuming low power and realizing a pixel having a long life.

Figure 7:
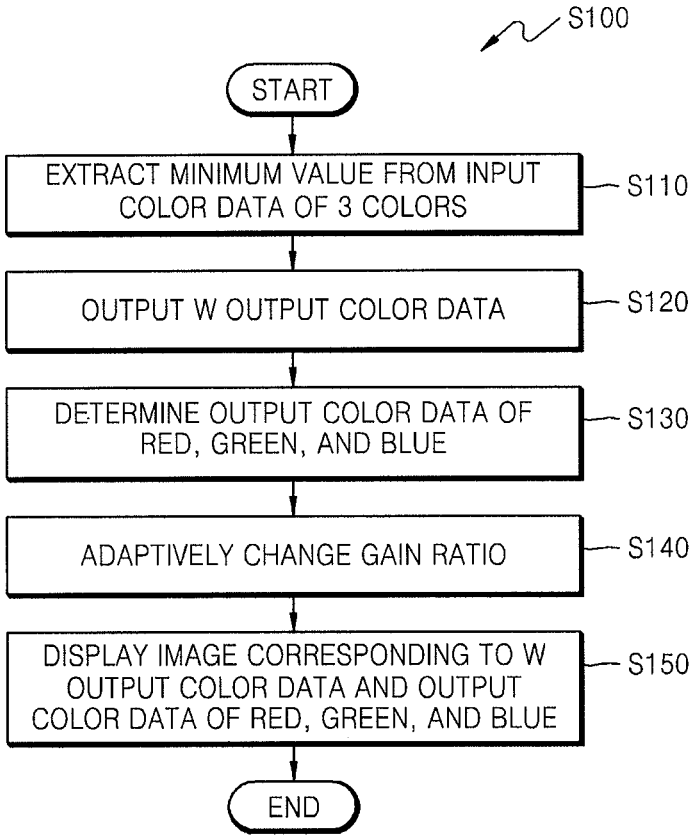
FIG. 7 is a flowchart illustrating a method of driving a display device, according to an embodiment of the present invention.

FIG. 7 is a flowchart illustrating a method S100 of driving a display device, according to an embodiment of the present invention. Referring to FIG. 7, a data mapping unit extracts a minimum value from input color data of 3 colors corresponding to red, green, and blue, in operation S110. The data mapping unit determines W output color data by multiplying the extracted minimum value and a gain ratio, in operation S120. The data mapping unit determines output color data of red, green, and blue by subtracting the W output color data from the input color data of 3 colors, in operation S130. A gain adjustment unit adaptively changes the gain ratio based on an image being displayed, in operation S140. A display panel displays an image corresponding to the W output color data and the output color data of red, green, and blue, in operation S150.

In detail, the gain adjustment unit may determine the gain ratio through accumulated sums of color data used according to sub-pixels in the image being displayed. Alternatively, the gain adjustment unit may change the gain ratio based on saturation of the image being displayed.

Accordingly, the method S100 according to an embodiment adaptively changes the gain ratio based on the image being displayed, and thus the display device may consume low power and have a long life.

The display device according to the embodiment of the present invention described above optimizes a trade off relationship between a life and power consumption, and thus a display device using low power consumption and having a long life may be realized.

While various features and aspects have been particularly shown and described with reference to exemplary embodiments, it will be understood by those of ordinary skill in the art that various changes in form and details may be made.

What is claimed is:

1. A display device comprising:

a data mapping unit configured to: i) determine a minimum value from input color data of three colors, ii) determine white output color data by multiplying the minimum value by a gain ratio, and iii) determine output color data of the three colors by subtracting the white output color data from each of the input color data of three colors;

a gain adjustment unit configured to adaptively change the gain ratio based on an image being displayed; and a display panel comprising a plurality of pixels, wherein each pixel is formed of a white sub-pixel and a sub-pixel of each of the three colors, wherein the display panel is configured to display an image using the sub-pixels according to the output color data of the three colors and the white output color data, wherein the gain adjustment unit is further configured to change the gain ratio based on an accumulated sum of color data for each of the red, green, blue, and white output color data, wherein the accumulated sum of color data for each of the red, green, blue and white output color data is the sum of the corresponding color data for all of the pixels of the display panel, and wherein the gain adjustment unit is further configured to: i) calculate a red comparative value, a green comparative value, and a blue comparative value by multiplying corresponding weights with the corresponding accumulated sums of color data, ii) calculate a white comparative value by using the accumulated sum of color data for the white output color data, and iii) determine the gain ratio by comparing the white comparative value with a sum of the three comparative values.

2. The display device of claim 1, wherein the gain adjustment unit is further configured to calculate the accumulated sums of color data according to regular frame intervals.

3. The display device of claim 1, wherein the gain adjustment unit is further configured to decrease the gain ratio if the sum of the three comparative values is greater than the white comparative value, and increases the gain ratio if the sum of the three comparative values is less than the white comparative value.

4. The display device of claim 3, wherein, if the gain ratio is increased or decreased, the gain adjustment unit increases or decreases the gain ratio by a first unit value.

5. The display device of claim 4, wherein the first unit value is determined based on a display state.

6. The display device of claim 1, wherein the gain adjustment unit is further configured to determine the corresponding weights multiplied with the accumulated sums of color data based on a degradation tendency of each of the sub-pixels and a display state.

7. The display device of claim 1, wherein the gain adjustment unit changes the gain ratio based on saturation of the image being displayed.

8. The display device of claim 7, wherein the gain adjustment unit calculates the saturation based on regular frame intervals.

9. The display device of claim 7, wherein the gain adjustment unit decreases the gain ratio if the saturation of a frame is greater than a first reference value, and increases the gain ratio if the saturation of the frame is less than a second reference value.

10. The display device of claim 9, wherein, if the gain ratio is increased or decreased, the gain adjustment unit increases or decreases the gain ratio by a second unit value.

11. The display device of claim 10, wherein the first reference value, the second reference value, and the second unit value are determined based on a display state.

12. A method of driving a display device comprising a display panel comprising a plurality of pixels, each of the pixels formed of red, green, blue, and white sub-pixels, the method comprising:

extracting, by a data mapping unit, a minimum value from red, green, and blue input color data;

determining, by the data mapping unit, white output color data by multiplying the extracted minimum value with a gain ratio;

determining, by the data mapping unit, red, green, and blue output color data by subtracting the white output color data from each of the red, green, and blue input color data;

adaptively changing, by a gain adjustment unit, the gain ratio based on an image being displayed;

determining, by the gain adjustment unit, the gain ratio based on an accumulated sum of color data for each of the red, green, blue, and white output color data, wherein the accumulated sum of color data for each of the red, green, blue and white output color data is the sum of the corresponding color data for all of the pixels of the display panel;

calculating, by the gain adjustment unit, a red comparative value, a green comparative value, and a blue comparative value by multiplying corresponding weights with the accumulated sum of color data;

calculating, by the gain adjustment unit, a white comparative value by using the accumulated sum of color data for the white output color data;

determining, by the gain adjustment unit, the gain ratio by comparing the white comparative value with a sum of the three comparative values; and displaying, by a display panel, an image corresponding to the white output color data and the red, green, and blue output color data.

13. The method of claim 12, wherein the gain adjustment unit changes the gain ratio based on saturation of the image being displayed.

14. The method of claim 13, wherein the gain ratio is decreased if the saturation of a frame is greater than a first reference value, and is increased if the saturation of the frame is less than a second reference value.

15. A display device comprising:

a display panel comprising a plurality of unit pixels each formed of red, green, blue, and white sub-pixels;

a data driver configured to supply one of four color data signals corresponding to red, green, blue, and white output color data to each of the plurality of unit pixels;

a gate driver configured to supply a gate-on voltage to the plurality of unit pixels; and a time controller configured to control the data driver and the gate driver, and to supply the red, green, blue, and white output color data to the data driver, wherein the time controller comprises:

a gain adjustment unit configured to: i) determine a minimum value from red, green, and blue input color data, and ii) determine the white output color data by multiplying the minimum value with a gain ratio that adaptively changes based on an image being displayed; and a data mapping unit configured to determine red, green, blue, and white output color data by subtracting the white output color data from the red, green, and blue input color data, wherein the gain adjustment unit is further configured to change the gain ratio based on an accumulated sum of color data for each of the red, green, blue, and white output color data, wherein the accumulated sum of color data for each of the red, green, blue and white output color data is the sum of the corresponding color data for all of the unit pixels of the display panel, and wherein the gain adjustment unit is further configured to i) calculate a red comparative value, a green comparative value, and a blue comparative value by multiplying corresponding weights with the accumulated sum of color data, ii) calculate a white comparative value by using the accumulated sum of color data for the white output color data, and iii) determine the gain ratio by comparing the white comparative value with a sum of the three comparative values.

16. The display device of claim 15, wherein the gain adjustment unit changes the gain ratio based on saturation of the image being displayed.

* * * * *